US008747968B2

(12) United States Patent
Nito et al.

(10) Patent No.: US 8,747,968 B2
(45) Date of Patent: Jun. 10, 2014

(54) RECORDING MEDIUM

(71) Applicant: Canon Kabushiki Kaisha, Tokyo (JP)

(72) Inventors: Yasuhiro Nito, Inagi (JP); Hisao Kamo, Ushiku (JP); Tetsuro Noguchi, Hachioji (JP); Ryo Taguri, Sagamihara (JP); Isamu Oguri, Yokohama (JP); Olivia Herlambang, Kawasaki (JP); Naoya Hatta, Kawasaki (JP); Shinya Yumoto, Kawasaki (JP); Kazuhiko Araki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/960,295

(22) Filed: Aug. 6, 2013

(65) Prior Publication Data

US 2014/0044898 A1 Feb. 13, 2014

(30) Foreign Application Priority Data

Aug. 8, 2012 (JP) ..... 2012-176023

(51) Int. Cl.

| | |
|---|---|
| ***B41M 5/00*** | (2006.01) |
| ***B41M 5/50*** | (2006.01) |
| ***B41M 5/52*** | (2006.01) |

(52) U.S. Cl.

CPC ..... *B41M 5/502* (2013.01); *B41M 5/506* (2013.01); *B41M 5/52* (2013.01); *B41M 5/5218* (2013.01)

USPC ..... 428/32.24; 428/32.25; 428/32.26; 428/32.34

(58) Field of Classification Search

CPC ..... B41M 5/502; B41M 5/506; B41M 5/52; B41M 5/5218

USPC ..... 428/32.24, 32.25, 32.26, 32.34

See application file for complete search history.

(56) References Cited

U.S. PATENT DOCUMENTS

2003/0072925 A1 * 4/2003 Kiyama et al. ..... 428/195

FOREIGN PATENT DOCUMENTS

| | | | |
|---|---|---|---|
| JP | 7-232473 | A | 9/1995 |
| JP | 8-132731 | A | 5/1996 |
| JP | 9-66664 | A | 3/1997 |
| JP | 9-76628 | A | 3/1997 |
| JP | 2003-341225 | A | 12/2003 |
| JP | 2008-265110 | A | 11/2008 |

* cited by examiner

*Primary Examiner* — Betelhem Shewareged

(74) *Attorney, Agent, or Firm* — Canon U.S.A., Inc., IP Division

(57) ABSTRACT

A recording medium includes, in sequence, a support, a first ink-receiving layer containing a first inorganic particle and a first binder, a second ink-receiving layer containing a second inorganic particle and a second binder, and a third ink-receiving layer which is an outermost surface layer and contains a third inorganic particle, a third binder, and a particle different from the third inorganic particle and having an average secondary particle size of 1.0 to 20.0 μm. A mass ratio of a content of the first binder to a content of the first inorganic particle is larger than a mass ratio of a content of the second binder to a content of the second inorganic particle. A content of the particle having the specific average secondary particle size is 0.5% by mass or more with respect to a content of the third inorganic particle.

11 Claims, 1 Drawing Sheet

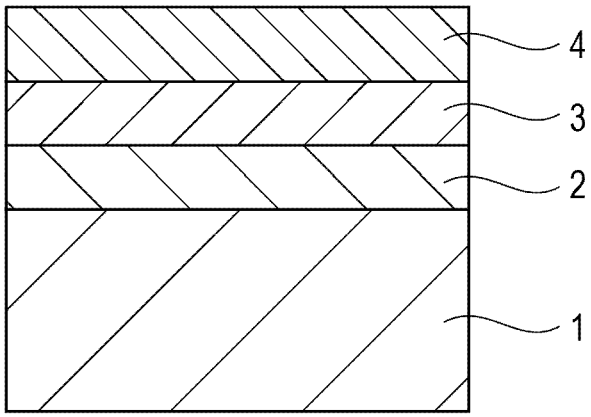
4
3
2
1

RECORDING MEDIUM

BACKGROUND OF THE INVENTION

1. Field of the Invention

The present invention relates to a recording medium.

2. Description of the Related Art

In order to obtain a recording medium having a high ink-absorbing property, a recording medium including a support and two ink-receiving layers provided on the support is known. Japanese Patent Laid-Open No. 2008-265110 discloses such a recording medium including a support and two ink-receiving layers provided on the support. Specifically, in the ink-receiving layer disposed closer to the support, the content of a binder is 7% by mass or more and 12% by mass or less relative to the content of hydrated alumina serving as inorganic particles. On the other hand, in the other ink-receiving layer disposed further away from the support, the content of a binder is 4% by mass or more and 6% by mass or less relative to the content of hydrated alumina.

Furthermore, in order to obtain a recording medium having high scratch resistance, incorporation of fine particles in an outermost surface layer of a recording medium has been studied. Japanese Patent Laid-Open No. 2003-341225 describes that scratch resistance of a recording medium is improved by incorporating inorganic fine particles having a size of 1 to 10 μm in an outermost surface layer of the recording medium.

Recently, the demand for photo-books and photo-albums has been increasing. One of properties required for a recording medium used for a photo-book or a photo-album is a property that pages are easily flipped through with a finger, that is, a good page-flipping property. In addition, in the field of commercial printing, it is assumed that when a photo-book or a photo-album is produced, a recording medium is subjected to high-speed printing and high-speed conveyance. Accordingly, the properties required for the recording medium used for a photo-book or a photo-album further include a high ink-absorbing property that can realize high-speed printing and a property that scratches are not readily formed by a conveying roller on a surface of the recording medium when the recording medium is conveyed at a high speed, that is, a high conveyance scratch resistance.

However, according to studies conducted by the inventors of the present invention, the recording media described in Japanese Patent Laid-Open Nos. 2008-265110 and 2003-341225 have room for improvement in terms of these properties.

SUMMARY OF THE INVENTION

The present invention provides a recording medium having a good page-flipping property, a high ink-absorbing property, and a high conveyance scratch resistance.

A recording medium according to an aspect of the present invention includes, in sequence, a support, a first ink-receiving layer, a second ink-receiving layer, and a third ink-receiving layer which is an outermost surface layer of the recording medium. The first ink-receiving layer contains a first inorganic particle and a first binder, and the second ink-receiving layer contains a second inorganic particle and a second binder. A mass ratio of a content of the first binder to a content of the first inorganic particle in the first ink-receiving layer is larger than a mass ratio of a content of the second binder to a content of the second inorganic particle in the second ink-receiving layer. The third ink-receiving layer contains a third inorganic particle, a third binder, and a particle which is different from the third inorganic particle and has an average secondary particle size of 1.0 μm or more and 20.0 μm or less, and a content of the particle having an average secondary particle size of 1.0 μm or more and 20.0 μm or less is 0.5% by mass or more with respect to a content of the third inorganic particle in the third ink-receiving layer.

According to the present invention, a recording medium having a good page-flipping property, a high ink-absorbing property, and a high conveyance scratch resistance can be provided.

Further features of the present invention will become apparent from the following description of exemplary embodiments with reference to the attached drawing.

BRIEF DESCRIPTION OF THE DRAWING

The FIGURE is a schematic cross-sectional view of a recording medium illustrating an example of a layer structure according to the present invention.

DESCRIPTION OF THE EMBODIMENTS

The present invention will be described in more detail by way of embodiments.

As a result of various studies conducted by the inventors of the present invention, it was found that the page-flipping property, the conveyance scratch resistance, and the ink-absorbing property are improved by incorporating particular particles in an ink-receiving layer functioning as an outermost surface layer of a recording medium in a particular amount, further providing two ink-receiving layers between the outermost surface layer and a support, and controlling a mass ratio of a content of a binder to a content of inorganic particles in each of the two ink-receiving layers to satisfy a particular relationship. In the present invention, a layer functioning as an outermost surface layer of a recording medium is referred to as a "third ink-receiving layer". The two ink-receiving layers disposed between the outermost surface layer and the support are respectively referred to as a "second ink-receiving layer" and a "first ink-receiving layer" from the third ink-receiving layer toward the support.

Specifically, in the present invention, the third ink-receiving layer contains inorganic particles, particles having an average secondary particle size of 1.0 μm or more and 20.0 μm or less (hereinafter also referred to as "large-size particles"), a binder, and a cross-linking agent, and the content of the large-size particles is 0.5% by mass or more relative to the content of the inorganic particles. Furthermore, in the two ink-receiving layers disposed between the outermost surface layer and the support, a mass ratio of a content of a binder to a content of inorganic particles in the first ink-receiving layer disposed closer to the support is larger than a mass ratio of a content of a binder to a content of inorganic particles in the second ink-receiving layer. With this structure, a recording medium having a good page-flipping property, a high ink-absorbing property, and a high conveyance scratch resistance can be obtained. The reason for this is believed to be as follows: Since the large-size particles are present on the surface of the recording medium, during image recording, the contact area between the surface of the recording medium and a conveying roller is decreased and scratches due to conveyance are less likely to be formed. In addition, when the recording medium is used in a photo-book or a photo-album, since the contact area between the recording medium and another recording medium used as a next page is decreased, the recording media are easily separated from each other when the pages are flipped through. Furthermore, in the two ink-receiving layers disposed between the outermost surface layer and the support, since the mass ratio of the content of the binder to the content of the inorganic particles in the first ink-receiving layer disposed closer to the support is larger than that in the second ink-receiving layer, the first ink-receiving layer has a smaller average pore radius. Consequently, the capillarity of the first ink-receiving layer, which is an ink-receiving layer closer to the support, is increased, and an ink applied onto the surface of the recording medium is absorbed with a strong force, thus increasing the ink-absorbing property. In this case, since a particular amount of the large-size particles are present in the third ink-receiving layer located on the surface of the recording medium, the ink applied onto the recording medium is first absorbed in pores each having a large volume and disposed between the large-size particles and then rapidly absorbed from the pores of the third ink-receiving layer toward the second and first ink-receiving layers by a strong capillarity. Therefore, the ink-absorbing property is further increased.

As described in the above mechanism, the structures of the respective ink-receiving layers synergistically affect each other, whereby the advantage of the present invention can be achieved.

Recording Medium

A recording medium according to an embodiment of the present invention includes a support, a first ink-receiving layer, a second ink-receiving layer, and a third ink-receiving layer which is an outermost surface layer of the recording medium in that order. An example of a layer structure according to the present invention will be described with reference to the FIGURE. As illustrated in the FIGURE, a recording medium includes a support 1, a first ink-receiving layer 2 disposed on the support 1, a second ink-receiving layer 3 disposed on the first ink-receiving layer 2, and a third ink-receiving layer 4 disposed on the second ink-receiving layer 3. In the present invention, the recording medium may be an ink-jet recording medium used in an ink-jet recording method. Components constituting the recording medium according to an embodiment of the present invention will be described below.

<Support>

Examples of the support include a support including only base paper and a support including base paper and a resin layer, that is, base paper coated with a resin. In the present invention, a support including base paper and a resin layer is preferably used. In such a case, the resin layer may be provided only on one surface of the base paper, but the resin layer is preferably provided on both surfaces of the base paper.

The base paper is produced by using wood pulp as a main material and optionally adding synthetic pulp composed of polypropylene or the like or synthetic fiber composed of nylon, polyester, or the like to make paper. Examples of the wood pulp include laubholz bleached kraft pulp (LBKP), laubholz bleached sulfite pulp (LBSP), nadelholz bleached kraft pulp (NBKP), nadelholz bleached sulfite pulp (NBSP), laubholz dissolving pulp (LDP), nadelholz dissolving pulp (NDP), laubholz unbleached kraft pulp (LUKP), and nadelholz unbleached kraft pulp (NUKP). These may be used alone or in combination of two or more thereof. Among these various types of wood pulp, LBKP, NBSP, LBSP, NDP, and LDP, which have a high content of a short fiber component, are preferably used. The pulp may be chemical pulp (sulfate pulp or sulfite pulp) that has a low impurity content. Pulp subjected to a bleaching treatment to improve the degree of whiteness may also be used. A sizing agent, a white pigment, a paper-strengthening agent, a fluorescent brightening agent, a water-retaining agent, a dispersant, a softening agent, and the like may be added into the base paper, as required.

In the present invention, a paper density of the base paper specified in JIS P 8118 is preferably 0.6 g/cm$^3$ or more and 1.2 g/cm$^3$ or less. Furthermore, the paper density is more preferably 0.7 g/cm$^3$ or more and 1.2 g/cm$^3$ or less.

In the present invention, when the support includes a resin layer, the thickness of the resin layer is preferably 20 μm or more and 60 μm or less. In the present invention, the thickness of the resin layer is calculated by the following method. First, a cross section of a recording medium is cut with a microtome, and the cross section is observed with a scanning electron microscope. Next, the thicknesses at arbitrary 100 points or more of the resin layer are measured, and the average thereof is defined as the thickness of the resin layer. Thicknesses of other layers in the present invention are also calculated by the same method.

In the case where a resin layer is provided on both surfaces of the base paper, each of the thicknesses of the resin layers on the two surfaces may satisfy the above range. The resin used in the resin layer may be a thermoplastic resin. Examples of the thermoplastic resin include acrylic resins, acrylic silicone resins, polyolefin resins, and styrene-butadiene copolymers. Among these resins, polyolefin resins are preferably used. In the present invention, the term "polyolefin resin" refers to a polymer obtained by using an olefin as a monomer. Specific examples thereof include homopolymers of ethylene, propylene, isobutylene, or the like and copolymers thereof. These polyolefin resins may be used alone or in combination of two or more resins, as required. Among these polyolefin resins, polyethylene is preferably used. Low-density polyethylene (LDPE) and high-density polyethylene (HDPE) are preferably used as polyethylene. The resin layer may contain a white pigment, a fluorescent brightening agent, ultramarine, etc. in order to adjust opacity, the degree of whiteness, and hue. Among these, a white pigment is preferably incorporated because opacity can be improved. Examples of the white pigment include rutile-type titanium dioxide and anatase-type titanium dioxide.

<Ink-Receiving Layer>

In the present invention, ink-receiving layers may be provided on only one surface of the support or on both surfaces of the support. In the present invention, the ink-receiving layers are preferably provided on both surfaces of the support. The total thickness of all the ink-receiving layers provided on one surface of the support is preferably 30 μm or more and 45 μm or less.

In the present invention, the ink-receiving layers are constituted by at least three layers, namely, a first ink-receiving layer, a second ink-receiving layer, and a third ink-receiving layer which is an outermost surface layer of the recording medium. A layer may further be provided on the third ink-receiving layer as long as the advantage of the present invention is not impaired. Materials that can be incorporated in each of the ink-receiving layers will now be described.

(First Ink-Receiving Layer)

In the present invention, the first ink-receiving layer contains inorganic particles and a binder. In order to distinguish from the materials constituting the second and third ink-receiving layers, the inorganic particles contained in the first ink-receiving layer are referred to as "first inorganic particles" and the binder contained in the first ink-receiving layer is referred to as a "first binder". The materials constituting respective ink-receiving layers may be the same or different. For example, the first inorganic particles in the first ink-receiving layer, second inorganic particles in the second ink-receiving layer, and third inorganic particles in the third ink-receiving layer may be the same or different.

The thickness of the first ink-receiving layer is preferably 20 μm or more and 35 μm or less, and more preferably 25 μm or more and 30 μm or less.

(1) Inorganic Particle

An average primary particle size of inorganic particles is preferably 50 nm or less, more preferably 1 nm or more and 30 nm or less, and particularly preferably 3 nm or more and 10 nm or less. In the present invention, the average primary particle size of inorganic particles is a number-average particle size of the diameters of circles having the areas equal to the projected areas of primary particles of the inorganic particles when the inorganic particles are observed with an electron microscope. In this case, the measurement is conducted at at least 100 points or more.

In the present invention, the inorganic particles may be used in an ink-receiving layer coating liquid in a state where the inorganic particles are dispersed with a dispersant. An average secondary particle size of the inorganic particles in the dispersed state is preferably 0.1 nm or more and 500 nm or less, more preferably 1 nm or more and 300 nm or less, and particularly preferably 10 nm or more and 250 nm or less. The average secondary particle size of the inorganic particles in the dispersed state can be measured by a dynamic light scattering method.

In the present invention, the content (% by mass) of the first inorganic particles in the first ink-receiving layer is preferably 30% by mass or more and 98% by mass or less, and more preferably 70% by mass or more and 96% by mass or less.

In the present invention, the amount ($g/m^2$) of first inorganic particles applied when the first ink-receiving layer is formed is preferably 8 $g/m^2$ or more and 45 $g/m^2$ or less. When the amount of first inorganic particles is in the above range, the first ink-receiving layer can easily have a preferred thickness. The amount of first inorganic particles applied is more preferably 15 $g/m^2$ or more and 30 $g/m^2$ or less.

Examples of the inorganic particles used in the present invention include particles composed of hydrated alumina, alumina, silica, colloidal silica, titanium dioxide, zeolite, kaolin, talc, hydrotalcite, zinc oxide, zinc hydroxide, aluminum silicate, calcium silicate, magnesium silicate, zirconium oxide, and zirconium hydroxide. These inorganic particles may be used alone or in combination of two or more inorganic particles, as required. Among the above inorganic particles, hydrated alumina, alumina, and silica, all of which can form a porous structure exhibiting a high ink-absorbing property, are preferably used.

Hydrated alumina that can be suitably used in the ink-receiving layer is one represented by general formula (X):

$$Al_2O_{3-n}(OH)_{2n}.mH_2O \qquad \text{General formula (X)}$$

(wherein n represents 0, 1, 2, or 3, m is 0 or more and 10 or less, preferably 0 or more and 5 or less, however, m and n are not zero at the same time.) Note that m may not represent an integer because, in many cases, $mH_2O$ represents an eliminable aqueous phase that does not participate in the formation of a crystal lattice. In addition, m can reach zero when the hydrated alumina is heated.

In the present invention, the hydrated alumina can be produced by a known method. Specifically, examples thereof include a method in which an aluminum alkoxide is hydrolyzed, a method in which sodium aluminate is hydrolyzed, and a method in which an aqueous solution of sodium aluminate is neutralized by adding an aqueous solution of aluminum sulfate or aluminum chloride thereto.

Known crystal structures of the hydrated alumina include amorphous, gibbsite, and boehmite in accordance with a heat-treatment temperature. The crystal structures of the hydrated alumina can be analyzed by X-ray diffractometry. In the present invention, among these, hydrated alumina having a boehmite structure or amorphous hydrated alumina is preferable. Specific examples thereof include hydrated alumina described in, for example, Japanese Patent Laid-Open Nos. 7-232473, 8-132731, 9-66664, and 9-76628. Examples of commercially available hydrated alumina include DISPERAL HP14 and HP18 (both of which are manufactured by Sasol). These may be used alone or in combination of two or more thereof, as required.

In the present invention, the hydrated alumina has a specific surface area of preferably 100 $m^2/g$ or more and 200 $m^2/g$ or less, and more preferably 125 $m^2/g$ or more and 190 $m^2/g$ or less, the specific surface area being determined by a BET method. The BET method is a method in which a molecule or an ion having a known size is allowed to be adsorbed on a surface of a sample, and the specific surface area of the sample is measured on the basis of the amount of adsorption. In the present invention, nitrogen gas is used as a gas that is allowed to be adsorbed on a sample.

The hydrated alumina preferably has a plate-like shape. Furthermore, an average aspect ratio which is a ratio of an average primary particle size of a flat-plate surface of the hydrated alumina to an average particle thickness of the hydrated alumina is preferably 3.0 or more and 10 or less. The average particle thickness is determined as follows. Hydrated alumina particles are observed with an electron microscope, and arbitrary 10 hydrated alumina particles are selected. The average particle thickness is calculated from the number average of the thicknesses of the 10 hydrated alumina particles. In addition, a ratio of the minimum particle size of the flat-plate surface to the maximum particle size of the flat-plate surface is preferably 0.60 or more and 1.0 or less.

Vapor-phase process alumina is preferably used as alumina in the ink-receiving layer. Examples of such vapor-phase process alumina include γ-alumina, α-alumina, δ-alumina, θ-alumina, and χ-alumina. Among these, from the standpoint of the optical density of an image and the ink-absorbing property, γ-alumina is preferably used. Specific examples of the vapor-phase process alumina include AEROXIDE Alu C, Alu 130, and Alu 65 (all of which are manufactured by EVONIK Industries).

In the present invention, the specific surface area of the vapor-phase process alumina determined by the BET method is preferably 50 $m^2/g$ or more, and more preferably 80 $m^2/g$ or more. The specific surface area of the vapor-phase process alumina is preferably 150 $m^2/g$ or less, and more preferably 120 $m^2/g$ or less.

The average primary particle size of the vapor-phase process alumina is preferably 5 nm or more, and more preferably 11 nm or more. The average primary particle size of the vapor-phase process alumina is preferably 30 nm or less, and more preferably 15 nm or less.

Hydrated alumina and alumina used in the present invention may be mixed in an ink-receiving layer coating liquid in the form of an aqueous dispersion liquid. An acid may be used as a dispersant for the aqueous dispersion liquid. A sulfonic acid represented by general formula (Y) is preferably used as the acid because an effect of suppressing bleeding of an image can be obtained:

$$R—SO_3H \qquad \text{General formula (Y)}$$

(wherein R represents a hydrogen atom, an alkyl group having 1 to 4 carbon atoms, or an alkenyl group having 1 to 4 carbon atoms, and R may be substituted with an oxo group, a halogen atom, an alkoxy group, or an acyl group.) In the present invention, the content of the acid is preferably 1.0% by mass or more and 2.0% by mass or less, and more preferably 1.3% by mass or more and 1.6% by mass or less relative to the total content of hydrated alumina and alumina.

Silica used in the ink-receiving layer is broadly divided into two types of silica, namely, silica obtained by a wet process and silica obtained by a dry process (vapor-phase process) in terms of production process thereof. A known wet process is a method in which active silica is produced by acid decomposition of a silicate, the active silica is appropriately polymerized to coagulate and sediment the polymerized product to obtain hydrated silica. Examples of a known dry process (vapor-phase process) include a method for obtaining anhydrous silica by a method (flame hydrolysis) in which a silicon halide is hydrolyzed in a vapor phase at a high temperature or a method (arc process) in which quartz sand and coke are heated, reduced, and gasified by arc in an electric furnace, and the resulting gas is oxidized with air. In the present invention, silica obtained by the dry process (vapor-phase process) (hereinafter also referred to as "vapor-phase-process silica") is preferably used. The reason for this is as follows. Vapor-phase-process silica has a particularly large specific surface area and thus has a particularly high ink-absorbing property. In addition, vapor-phase-process silica has a low refractive index and thus can impart transparency to the ink-receiving layer, thereby obtaining good color developability. Specific examples of vapor-phase-process silica include AEROSIL (manufactured by Nippon Aerosil Co., Ltd.) and Reolosil QS series (manufactured by TOKUYAMA Corporation).

In the present invention, the specific surface area of vapor-phase-process silica determined by the BET method is preferably 50 $m^2/g$ or more and 400 $m^2/g$ or less, and more preferably 200 $m^2/g$ or more and 350 $m^2/g$ or less.

In the present invention, vapor-phase-process silica is preferably used in an ink-receiving layer coating liquid in a state where particles of the vapor-phase-process silica are dispersed with a dispersant. The vapor-phase-process silica in the dispersed state more preferably has a particle size of 50 nm or more and 300 nm or less. The particle size of the vapor-phase-process silica in the dispersed state can be measured by a dynamic light scattering method.

In the present invention, hydrated alumina, alumina, and silica may be used as a mixture. Specifically, at least two selected from hydrated alumina, alumina, and silica may be mixed and dispersed in the form of a powder to prepare a dispersion liquid. In the present invention, hydrated alumina and vapor-phase process alumina are preferably used as the inorganic particles. In such a case, a mass ratio of the content (% by mass) of the hydrated alumina to the content (% by mass) of the vapor-phase process alumina contained in the first ink-receiving layer is preferably 60/40 or more and 95/5 or less. That is, the content of the hydrated alumina is preferably 1.5 times or more and 19.0 times or less the content of the vapor-phase process alumina. Furthermore, the mass ratio of the content of the hydrated alumina to the content of the vapor-phase process alumina is more preferably 75/25 or more and 85/15 or less. That is, the content of the hydrated alumina is preferably 3.0 times or more and 5.7 times or less the content of the vapor-phase process alumina.

(2) Binder

In the present invention, the term "binder" refers to a material that can bind inorganic particles to form a coating film.

In the present invention, a mass ratio $P_1$ of the content of the first binder to the content of the first inorganic particles in the first ink-receiving layer is preferably 10.5% by mass or more and 17.0% by mass or less. When the mass ratio $P_1$ is less than 10.5% by mass, a binding force between the inorganic particles in the ink-receiving layer is weak and the effect of improving the conveyance scratch resistance may not be sufficiently obtained. When the mass ratio $P_1$ is more than 17.0% by mass, the pore volume in the ink-receiving layer is small and the effect of improving the ink-absorbing property may not be sufficiently obtained.

Examples of the binder include starch derivatives such as oxidized starch, etherified starch, and phosphoric acid-esterified starch; cellulose derivatives such as carboxymethyl cellulose and hydroxyethyl cellulose; casein, gelatin, soybean protein, polyvinyl alcohol, and derivatives thereof; polyvinyl pyrrolidone; maleic anhydride resins; latexes of conjugated polymers such as styrene-butadiene copolymers and methyl methacrylate-butadiene copolymers; latexes of acrylic polymers such as acrylic acid ester polymers and methacrylic acid ester polymers; latexes of vinyl polymers such as ethylene-vinyl acetate copolymers; functional-group-modified polymer latexes obtained by modifying the above-mentioned polymers with a monomer having a functional group such as a carboxyl group; cationized polymers obtained by cationizing the above-mentioned polymers with a cationic group; cationized polymers obtained by cationizing the surfaces of the above-mentioned polymers with a cationic surfactant; polymers obtained by polymerizing a monomer constituting any of the above-mentioned polymers in the presence of cationic polyvinyl alcohol to distribute polyvinyl alcohol on the surfaces of the polymers; polymers obtained by polymerizing a monomer constituting any of the above-mentioned polymers in a suspended dispersion liquid of cationic colloidal particles to distribute the cationic colloidal particles on the surfaces of the polymers; aqueous binders of thermosetting synthetic resins, such as a melamine resin and a urea resin; polymers and copolymers of acrylic acid esters and methacrylic acid esters, such as polymethyl methacrylate; and synthetic resins such as polyurethane resins, unsaturated polyester resins, vinyl chloride-vinyl acetate copolymers, polyvinyl butyral, and alkyd resins. These binders may be used alone or in combination of two or more binders, as required.

Among the above binders, polyvinyl alcohol and polyvinyl alcohol derivatives are preferably used. Examples of the polyvinyl alcohol derivatives include cation-modified polyvinyl alcohol, anion-modified polyvinyl alcohol, silanol-modified polyvinyl alcohol, and polyvinyl acetal. As the cation-modified polyvinyl alcohol, as described in, for example, Japanese Patent Laid-Open No. 61-10483, a polyvinyl alcohol having any of primary to tertiary amino groups and a quaternary ammonium group in the main chain or a side chain thereof is preferable.

Polyvinyl alcohol can be synthesized by, for example, saponifying polyvinyl acetate. The degree of saponification of polyvinyl alcohol is preferably 80% by mole or more and 100% by mole or less, and more preferably 85% by mole or more and 98% by mole or less. Note that the degree of saponification is a ratio of the number of moles of hydroxyl group generated by a saponification reaction when polyvinyl alcohol is obtained by saponifying polyvinyl acetate. A value measured in accordance with the method described in JIS-K6726 is used in the present invention. An average degree of polymerization of polyvinyl alcohol is preferably 1,500 or more, and more preferably 2,000 or more and 5,000 or less. In the present invention, the viscosity-average degree of polymerization determined in accordance with the method described in JIS-K6726 is used as the average degree of polymerization.

In preparation of an ink-receiving layer coating liquid, polyvinyl alcohol or a polyvinyl alcohol derivative may be used in the form of an aqueous solution. In such a case, the solid content of the polyvinyl alcohol or the polyvinyl alcohol derivative in the aqueous solution is preferably 3% by mass or more and 10% by mass or less.

(3) Cross-Linking Agent

In the present invention, the first ink-receiving layer may further contain a first cross-linking agent. Examples of the cross-linking agent include aldehyde compounds, melamine compounds, isocyanate compounds, zirconium compounds, amide compounds, aluminum compounds, boric acids, and borates. These cross-linking agents may be used alone or in combination of two or more compounds, as required. In particular, when polyvinyl alcohol or a polyvinyl alcohol derivative is used as the binder, among the cross-linking agents mentioned above, boric acids and borates are preferably used. That is, the first cross-linking agent, a second cross-linking agent, and a third cross-linking agent are each independently preferably at least one selected from boric acids and borates.

Examples of the boric acid include orthoboric acid ($H_3BO_3$), metaboric acid, and diboric acid. The borate may be a water-soluble salt of any one of the boric acids mentioned above. Examples thereof include alkali metal salts of a boric acid such as a sodium salt of a boric acid and a potassium salt of a boric acid; alkaline earth metal salts of a boric acid such as a magnesium salt of a boric acid and a calcium salt of a boric acid; and ammonium salts of a boric acid. Among these, orthoboric acid is preferably used from the standpoint of the stability of the coating liquid with time, and an effect of suppressing the generation of cracks.

The amount of cross-linking agent used can be appropriately adjusted in accordance with the production conditions etc. In the present invention, a mass ratio $B_1$ of the content of the first cross-linking agent to the content of the first binder in the first ink-receiving layer is preferably 1.0% by mass or more and 50.0% by mass or less, and more preferably 10.5% by mass or more and 20.0% by mass or less.

Furthermore, in the case where the binder is polyvinyl alcohol and the cross-linking agent is at least one selected from boric acids and borates, the total content of the boric acids and the borates relative to the content of polyvinyl alcohol in the first ink-receiving layer is preferably 10% by mass or more and 15% by mass or less.

A mass ratio of the content of the cross-linking agent to the content of the inorganic particles in the first ink-receiving layer is preferably 1.5% by mass or more and 2.5% by mass or less.

(4) Other Additives

In the present invention, the first ink-receiving layer may contain additives other than the components described above. Specific examples of the additives include a pH adjustor, a thickener, a fluidity improver, an antifoaming agent, a foam inhibitor, a surfactant, a mold-releasing agent, a penetrant, a color pigment, a color dye, a fluorescent brightening agent, an ultraviolet absorber, an antioxidant, an antiseptic agent, an antifungal agent, a waterproofing agent, a dye fixing agent, a curing agent, and a weather resistant material.

(Second Ink-Receiving Layer)

The second ink-receiving layer contains second inorganic particles and a second binder. The thickness of the second ink-receiving layer is preferably 5 μm or more and 15 μm or less.

(1) Inorganic Particle

As the second inorganic particles of the second ink-receiving layer, it is possible to use inorganic particles the same as those exemplified as inorganic particles that can be used in the first ink-receiving layer. Preferable ranges regarding physical properties of the second inorganic particles are also the same as those of the first inorganic particles except for the range described below. The same applies to the descriptions below regarding a binder and a cross-linking agent.

In the present invention, the content (% by mass) of the second inorganic particles in the second ink-receiving layer is preferably 30% by mass or more and 98% by mass or less, and more preferably 70% by mass or more and 96% by mass or less.

In the present invention, the amount ($g/m^2$) of second inorganic particles applied when the second ink-receiving layer is formed is preferably 3 $g/m^2$ or more and 15 $g/m^2$ or less. When the amount of second inorganic particles is in the above range, the second ink-receiving layer can easily have a preferred thickness.

(2) Binder

As the binder of the second ink-receiving layer, it is possible to use compounds the same as those exemplified as a binder that can be used in the first ink-receiving layer.

In the present invention, a mass ratio $P_2$ of the content of the second binder to the content of the second inorganic particles in the second ink-receiving layer is preferably 7.0% by mass or more and 10.5% by mass or less. When the mass ratio $P_2$ is less than 7.0% by mass, a binding force between the inorganic particles in the ink-receiving layer is weak and the effect of improving the conveyance scratch resistance may not be sufficiently obtained. When the mass ratio $P_2$ is more than 10.5% by mass, the pore volume in the ink-receiving layer is small and the effect of improving the ink-absorbing property may not be sufficiently obtained.

(3) Cross-Linking Agent

In the present invention, the second ink-receiving layer may further contain a second cross-linking agent. As the cross-linking agent of the second ink-receiving layer, it is possible to use compounds the same as those exemplified as a cross-linking agent that can be used in the first ink-receiving layer.

The amount of cross-linking agent used can be appropriately adjusted in accordance with the production conditions etc. In the present invention, a mass ratio $B_2$ of the content of the second cross-linking agent to the content of the second binder in the second ink-receiving layer is preferably 1.0% by mass or more and 50% by mass or less, and more preferably 8.8% by mass or more and 23.8% by mass or less.

Furthermore, in the case where the binder is polyvinyl alcohol and the cross-linking agent is at least one selected from boric acids and borates, the total content of the boric acids and the borates relative to the content of polyvinyl alcohol in the second ink-receiving layer is preferably 10% by mass or more and 15% by mass or less.

A mass ratio of the content of the cross-linking agent to the content of the inorganic particles in the second ink-receiving layer is preferably 1.1% by mass or more and 1.4% by mass or less.

(4) Other Additives

In the present invention, the second ink-receiving layer may contain additives other than the components described above. Specifically, it is possible to use additives the same as those exemplified as the other additives that can be used in the first ink-receiving layer.

(Third Ink-Receiving Layer)

The third ink-receiving layer contains third inorganic particles, particles that are different from the third inorganic particles and have an average secondary particle size of 1.0 μm or more and 20.0 μm or less, a third binder, and a third cross-linking agent. The thickness of the third ink-receiving layer is preferably 0.1 μm or more and 18 μm or less, and more preferably 0.1 μm or more and 5 μm or less, and particularly preferably 0.2 μm or more and 2.0 μm or less.

(1) Inorganic Particle

As the third inorganic particles of the third ink-receiving layer, it is possible to use inorganic particles the same as those exemplified as inorganic particles that can be used in the first ink-receiving layer.

In the present invention, the content (% by mass) of the third inorganic particles in the third ink-receiving layer is preferably 30% by mass or more and 98% by mass or less, and more preferably 70% by mass or more and 96% by mass or less.

In the present invention, the amount ($g/m^2$) of third inorganic particles applied when the third ink-receiving layer is formed is preferably 0.1 $g/m^2$ or more and 18 $g/m^2$ or less. When the amount of third inorganic particles is in the above range, the third ink-receiving layer can easily have a preferred thickness.

(2) Particle Different from Third Inorganic Particle and Having Average Secondary Particle Size of 1.0 μm or More and 20.0 μm or Less In the present invention, the third ink-receiving layer contains large-size particles that are different from the third inorganic particles and have an average secondary particle size of 1.0 μm or more and 20.0 μm or less. The average secondary particle size is preferably 2.0 μm or more and 10.0 μm or less, and more preferably 2.0 μm or more and 6.0 μm or less. When the average secondary particle size of the particles is less than 1.0 μm, the page-flipping property of the recording medium may not be sufficiently obtained. In addition, the particles are densely arranged, which may result in a decrease in the ink-absorbing property. When the average secondary particle size of the particles is more than 20.0 μm, binding between the particles is weak and thus the conveyance scratch resistance may decrease. The average secondary particle size of the particles having an average secondary particle size of 1.0 μm or more and 20.0 μm or less is preferably larger than the average secondary particle size of the third inorganic particles in the third ink-receiving layer. The average secondary particle size of the large-size particles is determined as follows. A surface of a recording medium is observed with a scanning electron microscope at a magnification of 50,000, and arbitrary 100 particles present on the surface are selected. The particle sizes of the 100 particles are measured, and the number average of the particle size is calculated.

The content of the large-size particles in the third ink-receiving layer is 0.5% by mass or more relative to the content of the third inorganic particles. Furthermore, the content of the large-size particles is more preferably 5.0% by mass or less. The content of the large-size particles is particularly preferably 1.5% by mass or more and 4.0% by mass or less. When the content of the large-size particles is less than 0.5% by mass, the amount of large-size particles is small and the page-flipping property and the conveyance scratch resistance may not be sufficiently obtained. When the content of the large-size particles exceeds 5.0% by mass, the amount of large-size particles is large and irregularities are formed on the surface, which may result in a decrease in glossiness.

Examples of the large-size particles include wet-process silica and resin particles. In the present invention, wet-process silica is preferably used. Wet-process silica is silica obtained by a wet process in which active silica is produced by acid decomposition of a silicate, the active silica is appropriately polymerized to coagulate and sediment the polymerized product to obtain hydrated silica. In particular, precipitation-process silica or gel-process silica is preferable. Precipitation-process silica can be obtained by allowing sodium silicate with sulfuric acid under an alkali condition. Specific examples of precipitation-process silica include NIPSIL K-500 (manufactured by Tosoh Silica Corporation) and FINESIL; X-37, X-37B, and X-45 (all of which are manufactured by Tokuyama Corporation). Gel-process silica can be obtained by allowing sodium silicate with sulfuric acid under an acidic condition. Specific examples of gel-process silica include MIZUKASIL P-707 and P78A (both of which are manufactured by Mizusawa Industrial Chemicals, Ltd.). The surface of wet-process silica is usually anionically charged. Wet-process silica whose surface is anionically charged can also be suitably used because of high compatibility with inorganic particles. Alternatively, the surface of wet-process silica may be cationically charged by a cationic resin.

Examples of the resin particles include particles composed of a polyamide resin, a polyester resin, a polycarbonate resin, a polyolefin resin, a polysulfone resin, a polystyrene resin, a polyvinyl chloride resin, a polyvinylidene chloride resin, a polyphenylene sulfide resin, an ionomer resin, an acrylic resin, a vinyl resin, an urea resin, a melamine resin, a urethane resin, nylon, a cellulose compound, and starch. Among these, a polyolefin resin is preferable. The shape of the resin particles is not particularly limited. The closer the shape of the resin particles is to a sphere, the better. The shape of the resin particles is more preferably a spherical shape. From the standpoint of compatibility, the surfaces of the resin particles preferably have the same ionicity as that of the inorganic particles used in the ink-receiving layer, or are preferably nonionic. For example, in the case where the inorganic particles are cationic, the resin particles used are preferably cationic or nonionic.

(3) Binder

As the binder of the third ink-receiving layer, it is possible to use compounds the same as those exemplified as a binder that can be used in the first ink-receiving layer.

In the present invention, a mass ratio of the content of the third binder to the content of the third inorganic particles in the third ink-receiving layer is preferably 7.0% by mass or more and 11.0% by mass or less, and more preferably 8.0% by mass or more and 10.0% by mass or less.

(4) Cross-Linking Agent

In the present invention, the third ink-receiving layer may further contain a third cross-linking agent. As the cross-linking agent of the third ink-receiving layer, it is possible to use compounds the same as those exemplified as a cross-linking agent that can be used in the first ink-receiving layer.

The amount of cross-linking agent used can be appropriately adjusted in accordance with the production conditions etc. In the present invention, a mass ratio of the content of the third cross-linking agent to the content of the third binder in the third ink-receiving layer is preferably 10.0% by mass or more and 30.0% by mass or less, and more preferably 12.0% by mass or more and 25.0% by mass or less.

(5) Other Additives

In the present invention, the third ink-receiving layer may contain additives other than the components described above. Specifically, it is possible to use additives the same as those exemplified as the other additives that can be used in the first ink-receiving layer (Relationship Between Respective Ink-Receiving Layers)

As described above, in the present invention, the mass ratio $P_1$ of the content of the first binder to the content of the first inorganic particles in the first ink-receiving layer is larger than the mass ratio $P_2$ of the content of the second binder to the content of the second inorganic particles in the second ink-receiving layer.

Method for Producing Recording Medium

In the present invention, a method for producing a recording medium is not particularly limited. The method for producing a recording medium may include a step of preparing an ink-receiving layer coating liquid, and a step of applying the ink-receiving layer coating liquid onto a support. A method for producing a recording medium will be described below.

<Method for Preparing Support>

In the present invention, a commonly used method for making paper can be used as a method for preparing base paper. Examples of a paper machine include a Fourdrinier machine, a cylinder machine, a drum machine, and a twin-wire machine. In order to increase the surface smoothness of base paper, a surface treatment may be performed by applying heat and a pressure during or after a papermaking process. Specific examples of the surface treatment method include a calender treatment such as machine calendering and super calendering.

Examples of a method for providing a resin layer on base paper, that is, a method for coating base paper with a resin, include a melt extrusion method, a wet lamination method, and a dry lamination method. Among these methods, a melt extrusion method is preferable in which a molten resin is extruded on a surface or both surfaces of base paper to coat the base paper with the resin. An example of a widely used method is a method (also referred to as an "extrusion coating method") including bringing a resin extruded from an extrusion die into contact with base paper that has been conveyed at a nip point between a nip roller and a cooling roller, and pressure-bonding the resin and the base paper with a nip to laminate the base paper with a resin layer. In the formation of a resin layer by the melt extrusion method, a pretreatment may be conducted so that the base paper and the resin layer more firmly adhere to each other. Examples of the pretreatment include an acid etching treatment with a mixture of sulfuric acid and chromic acid, a flame treatment with a gas flame, an ultraviolet irradiation treatment, a corona discharge treatment, a glow discharge treatment, and an anchor coating treatment with an alkyl titanate or the like. Among these pretreatments, a corona discharge treatment is preferable.

<Method for Forming Ink-Receiving Layer>

In the recording medium according to an embodiment of the present invention, for example, the following methods can be employed as a method for forming an ink-receiving layer on a support. First, ink-receiving layer coating liquids are prepared, and the coating liquids are then applied onto a support and dried. Thus, a recording medium according to an embodiment of the present invention can be obtained. In the present invention, a sequential coating method or a simultaneous multilayer coating method may be employed. In the sequential coating method, coating liquids for forming the respective ink-receiving layers are prepared, a coating liquid for forming the first ink-receiving layer is applied onto a support and then dried, a coating liquid for forming the second ink-receiving layer is applied thereon and then dried, and a coating liquid for forming the third ink-receiving layer is applied thereon and then dried. In the simultaneous multilayer coating method, coating liquids for forming the respective ink-receiving layers are prepared, and the coating liquids are simultaneously applied onto a support. In particular, the simultaneous multilayer coating method using a slide bead system, a slide curtain system, or the like is preferable from the standpoint of high productivity. The coating liquids may be heated during coating. Examples of the drying method after coating include methods using a hot-air dryer such as a linear tunnel dryer, an arch dryer, an air-loop dryer, or a sine-curve air float dryer; and methods using a dryer that uses infrared rays, heating, microwaves, or the like.

Examples

The present invention will be described in more detail by way of Examples and Comparative Examples. The present invention is not limited by the Examples described below as long as it does not exceed the gist of the present invention. Note that the term "part" in the description of Examples below is on a mass basis unless otherwise specified.

Preparation of Recording Medium

<Preparation of Support>

Eighty parts of LBKP having a freeness of 450 mL in terms of Canadian Standard Freeness (CSF), 20 parts of NBKP having a freeness of 480 mL in terms of Canadian Standard Freeness (CSF), 0.60 parts of cationized starch, 10 parts of heavy calcium carbonate, 15 parts of light calcium carbonate, 0.10 parts of an alkyl ketene dimer, and 0.030 parts of cationic polyacrylamide were mixed. Water was added to the resulting mixture such that the mixture had a solid content of 3.0% by mass, thereby preparing a paper material. Subsequently, the paper material was subjected to paper making with a Fourdrinier machine, in which three-stage wet pressing was performed, followed by drying with a multi-cylinder dryer. The resulting paper was then impregnated with an aqueous solution of oxidized starch using a size press device so as to have a solid content of 1.0 g/m$^2$ after drying, and then dried. Furthermore, the paper was subjected to machine calender finishing to prepare base paper having a basis weight of 170 g/m$^2$, a Stockigt sizing degree of 100 seconds, an air permeability of 50 seconds, a Bekk smoothness of 30 seconds, a Gurley stiffness of 11.0 mN, and a thickness of 100 μm. Next, a resin composition containing 70 parts of low-density polyethylene, 20 parts of high-density polyethylene, and 10 parts of titanium oxide was applied onto a surface of the base paper such that the dry coating amount was 25 g/m$^2$. This surface is referred to as a "main surface" of a support. Furthermore, a resin composition containing 50 parts of low-density polyethylene was applied onto another surface of the base paper such that the dry coating amount was 25 g/m$^2$. Thus, a support was prepared.

<Preparation of Inorganic Particle Dispersion Liquids>

(Preparation of Inorganic Particle Dispersion Liquid 1)

To 160.0 g of pure water, 40.0 g of a hydrated alumina DISPERAL HP14 (manufactured by Sasol) and 0.6 g (1.5% by mass relative to the solid content of the hydrated alumina) of methanesulfonic acid were added. The resulting mixture was then stirred with a mixer for 30 minutes. Thus, an inorganic particle dispersion liquid 1 (solid content: 20.0% by mass) containing the hydrated alumina as inorganic particles was prepared. The hydrated alumina in the inorganic particle dispersion liquid 1 had an average primary particle size of 130 nm.

(Preparation of Inorganic Particle Dispersion Liquid 2)

To 160.0 g of pure water, 40.0 g of a vapor-phase process alumina AEROXIDE Alu C (manufactured by EVONIK Industries) and 0.5 g (1.3% by mass relative to the solid content of the vapor-phase process alumina) of methanesulfonic acid were added. The resulting mixture was then stirred with a mixer for 30 minutes. Thus, an inorganic particle dispersion liquid 2 (solid content: 20.0% by mass) containing the vapor-phase process alumina as inorganic particles was prepared. The vapor-phase process alumina in the inorganic particle dispersion liquid 2 had an average primary particle size of 160 nm.

(Preparation of Inorganic Particle Dispersion Liquid 3)

To 160.0 g of pure water, 40.0 g of a vapor-phase process alumina AEROXIDE Alu 65 (manufactured by EVONIK Industries) and 0.5 g (1.3% by mass relative to the solid content of the vapor-phase process alumina) of methanesulfonic acid were added. The resulting mixture was then stirred with a mixer for 30 minutes. Thus, an inorganic particle dispersion liquid 3 (solid content: 20.0% by mass) containing the vapor-phase process alumina as inorganic particles was prepared. The vapor-phase process alumina in the inorganic particle dispersion liquid 3 had an average primary particle size of 180 nm.

(Preparation of Inorganic Particle Dispersion Liquid 4)

To 160.0 g of pure water, 40.0 g of a vapor-phase process alumina AEROXIDE Alu 130 (manufactured by EVONIK Industries) and 0.5 g (1.3% by mass relative to the solid content of the vapor-phase process alumina) of methanesulfonic acid were added. The resulting mixture was then stirred with a mixer for 30 minutes. Thus, an inorganic particle dispersion liquid 4 (solid content: 20.0% by mass) containing the vapor-phase process alumina as inorganic particles was prepared. The vapor-phase process alumina in the inorganic particle dispersion liquid 4 had an average primary particle size of 150 nm.

<Aqueous Binder Solution>

An aqueous binder solution having a solid content of 9.0% by mass was prepared by using a polyvinyl alcohol PVA 235 (manufactured by Kuraray Co., Ltd.) having a degree of polymerization of 3,500 and a degree of saponification of 88% by mole.

<Preparation of Large-Size Particle>

Large-size particles were prepared as described below, and the average secondary particle sizes of the particles were measured.

(Wet-Process Silica Particle)

Particle A: FINESIL X-37B (manufactured by Tokuyama Corporation, average secondary particle size: 3.0 μm)

Particle B: NIPGEL BY-001 (manufactured by Tosoh Silica Corporation, average secondary particle size: 20.0 μm)

Particle C: MIZUKASIL P-707A (manufactured by Mizusawa Industrial Chemicals, Ltd., average secondary particle size: 1.0 μm)

Particle D: MIZUKASIL P-707M (manufactured by Mizusawa Industrial Chemicals, Ltd., average secondary particle size: 35.0 μm)

(Resin Particle)

Particle E: NBX-8 (manufactured by Sekisui Plastics Co., Ltd., average primary particle size: 5.0 μm)

<Preparation of Recording Medium>

A first coating liquid, a second coating liquid, a third coating liquid were simultaneously applied onto the support prepared above in that order with a curtain coater, and dried with hot air at 100° C., thus obtaining a recording medium. In this step, the film thicknesses (μm) were controlled to the values shown in Tables 1 and 2. The first and second coating liquids used were each prepared by mixing the inorganic particle dispersion liquid prepared above (solid content: 20.0% by mass), the aqueous binder solution (solid content: 9.0% by mass), and an aqueous boric acid solution (solid content: 5.0% by mass) functioning as a cross-linking agent so that the ratio of the solid contents was controlled to the ratio shown in Table 1. The third coating liquid used was prepared by mixing the inorganic particle dispersion liquid (solid content: 20.0% by mass), large-size particles, the aqueous binder solution (solid content: 9.0% by mass), and an aqueous boric acid solution (solid content: 5.0% by mass) so that the ratio of the solid contents was controlled to the ratio shown in Table 2.

TABLE 1

Conditions for preparation of recording medium

| | First coating liquid | | | | | | Second coating liquid | | | | | |
|---|---|---|---|---|---|---|---|---|---|---|---|---|
| Recording medium No. | Inorganic particle dispersion liquid 1 (Part) | Binder (Part) | Cross-linking agent (Part) | Film thickness (μm) | $P_1$*1 | $B_1$*2 | Inorganic particle dispersion liquid 1 (Part) | Binder (Part) | Cross-linking agent (Part) | Film thickness (μm) | $P_2$*3 | $B_2$*4 |
| Recording medium 1 | 100 | 11.0 | 1.5 | 25 | 11.0 | 13.6 | 100 | 7.0 | 1.1 | 10 | 7.0 | 15.7 |
| Recording medium 2 | 100 | 13.0 | 1.5 | 25 | 13.0 | 11.5 | 100 | 8.5 | 1.1 | 10 | 8.5 | 12.9 |
| Recording medium 3 | 100 | 15.0 | 1.5 | 25 | 15.0 | 10.0 | 100 | 10.0 | 1.1 | 10 | 10.0 | 11.0 |
| Recording medium 4 | 100 | 17.0 | 1.5 | 25 | 17.0 | 8.8 | 100 | 8.5 | 1.2 | 10 | 8.5 | 14.1 |
| Recording medium 5 | 100 | 11.0 | 1.8 | 25 | 11.0 | 16.4 | 100 | 8.5 | 1.4 | 10 | 8.5 | 16.5 |
| Recording medium 6 | 100 | 11.0 | 2.2 | 25 | 11.0 | 20.0 | 100 | 10.0 | 1.4 | 10 | 10.0 | 14.0 |
| Recording medium 7 | 100 | 11.0 | 2.3 | 25 | 11.0 | 20.9 | 100 | 7.0 | 1.4 | 10 | 7.0 | 20.0 |
| Recording medium 8 | 100 | 11.0 | 2.5 | 25 | 11.0 | 22.7 | 100 | 6.0 | 1.1 | 10 | 6.0 | 18.3 |
| Recording medium 9 | 100 | 17.0 | 2.5 | 25 | 17.0 | 14.7 | 100 | 8.5 | 1.1 | 10 | 8.5 | 12.9 |
| Recording medium 10 | 100 | 10.0 | 1.5 | 25 | 10.0 | 15.0 | 100 | 11.0 | 1.1 | 10 | 11.0 | 10.0 |
| Recording medium 11 | 100 | 10.0 | 1.5 | 25 | 10.0 | 15.0 | 100 | 7.0 | 1.1 | 10 | 7.0 | 15.7 |
| Recording medium 12 | 100 | 19.0 | 1.5 | 16 | 19.0 | 7.9 | 100 | 7.0 | 1.0 | 10 | 7.0 | 14.3 |
| Recording medium 13 | 100 | 11.0 | 1.3 | 18 | 11.0 | 11.8 | 100 | 7.0 | 1.5 | 10 | 7.0 | 21.4 |
| Recording medium 14 | 100 | 11.0 | 3.0 | 21 | 11.0 | 27.3 | 100 | 7.0 | 1.1 | 10 | 7.0 | 15.7 |
| Recording medium 15 | 100 | 11.0 | 1.5 | 23 | 11.0 | 13.6 | 100 | 7.0 | 1.1 | 10 | 7.0 | 15.7 |
| Recording medium 16 | 100 | 11.0 | 1.5 | 25 | 11.0 | 13.6 | 100 | 7.0 | 1.1 | 10 | 7.0 | 15.7 |
| Recording medium 17 | 100 | 11.0 | 1.5 | 25 | 11.0 | 13.6 | 100 | 11.0 | 1.1 | 10 | 11.0 | 10.0 |
| Recording medium 18 | 100 | 7.0 | 1.1 | 25 | 7.0 | 15.7 | 100 | 11.0 | 1.5 | 10 | 11.0 | 13.6 |
| Recording medium 19 | 100 | 11.0 | 1.5 | 25 | 11.0 | 13.6 | 100 | 7.0 | 1.1 | 10 | 7.0 | 15.7 |
| Recording medium 20 | 100 | 11.0 | 1.5 | 25 | 11.0 | 13.6 | 100 | 7.0 | 1.1 | 10 | 7.0 | 15.7 |
| Recording medium 21 | 100 | 11.0 | 1.5 | 25 | 11.0 | 13.6 | 100 | 7.0 | 1.1 | 10 | 7.0 | 15.7 |
| Recording medium 22 | 100 | 11.0 | 1.5 | 25 | 11.0 | 13.6 | 100 | 7.0 | 1.1 | 10 | 7.0 | 15.7 |
| Recording medium 23 | 100 | 11.0 | 1.5 | 25 | 11.0 | 13.6 | 100 | 7.0 | 1.1 | 10 | 7.0 | 15.7 |

TABLE 1-continued

| Conditions for preparation of recording medium | | | | | | | | | | | | |
|---|---|---|---|---|---|---|---|---|---|---|---|---|
| | First coating liquid | | | | | | Second coating liquid | | | | | |
| Recording medium No. | Inorganic particle dispersion liquid 1 (Part) | Binder (Part) | Cross-linking agent (Part) | Film thickness (μm) | $P_1$*1 | $B_1$*2 | Inorganic particle dispersion liquid 1 (Part) | Binder (Part) | Cross-linking agent (Part) | Film thickness (μm) | $P_2$*3 | $B_2$*4 |
| Recording medium 24 | 100 | 11.0 | 1.5 | 25 | 11.0 | 13.6 | 100 | 7.0 | 1.1 | 10 | 7.0 | 15.7 |
| Recording medium 25 | 100 | 11.0 | 1.5 | 25 | 11.0 | 13.6 | 100 | 7.0 | 1.1 | 10 | 7.0 | 15.7 |
| Recording medium 26 | 100 | 11.0 | 1.5 | 25 | 11.0 | 13.6 | 100 | 7.0 | 1.1 | 10 | 7.0 | 15.7 |
| Recording medium 27 | 100 | 11.0 | 1.5 | 25 | 11.0 | 13.6 | 100 | 7.0 | 1.1 | 10 | 7.0 | 15.7 |
| Recording medium 28 | 100 | 11.0 | 1.5 | 25 | 11.0 | 13.6 | 100 | 7.0 | 1.1 | 10 | 7.0 | 15.7 |
| Recording medium 29 | 100 | 11.0 | 1.5 | 25 | 11.0 | 13.6 | 100 | 7.0 | 1.1 | 10 | 7.0 | 15.7 |
| Recording medium 30 | 100 | 11.0 | 1.5 | 25 | 11.0 | 13.6 | 100 | 7.0 | 1.1 | 10 | 7.0 | 15.7 |
| Recording medium 31 | 100 | 11.0 | 1.5 | 25 | 11.0 | 13.6 | 100 | 7.0 | 1.1 | 10 | 7.0 | 15.7 |
| Recording medium 32 | 100 | 11.0 | 1.5 | 25 | 11.0 | 13.6 | 100 | 7.0 | 1.1 | 10 | 7.0 | 15.7 |
| Recording medium 33 | 100 | 11.0 | 1.5 | 25 | 11.0 | 13.6 | 100 | 7.0 | 1.1 | 10 | 7.0 | 15.7 |
| Recording medium 34 | 100 | 11.0 | 1.5 | 25 | 11.0 | 13.6 | 100 | 7.0 | 1.1 | 10 | 7.0 | 15.7 |

*1Mass ratio of content of binder to content of inorganic particles in first ink-receiving layer

*2Mass ratio of content of cross-linking agent to content of binder in first ink-receiving layer

*3Mass ratio of content of binder to content of inorganic particles in second ink-receiving layer

*4Mass ratio of content of cross-linking agent to content of binder in second ink-receiving layer

TABLE 2

| Conditions for preparation of recording medium | | | | | | | | | | |
|---|---|---|---|---|---|---|---|---|---|---|
| | Third coating liquid | | | | | | | | | |
| Recording medium No. | Inorganic particle dispersion liquid 1 (Part) | Other inorganic particle dispersion liquid Type | Other inorganic particle dispersion liquid (Part) | Large-size particle Type | Large-size particle Particle size (μm) | Large-size particle (Part) | Binder (Part) | Cross-linking agent (Part) | Film thickness (μm) | Large-size particle/Inorganic particle (mass %) |
| Recording medium 1 | 100 | — | 0 | Particle A | 3.0 | 2.0 | 7.0 | 1.1 | 1.0 | 2.0 |
| Recording medium 2 | 100 | — | 0 | Particle A | 3.0 | 2.0 | 7.0 | 1.1 | 1.0 | 2.0 |
| Recording medium 3 | 100 | — | 0 | Particle E | 5.0 | 2.0 | 7.0 | 1.1 | 1.0 | 2.0 |
| Recording medium 4 | 100 | — | 0 | Particle E | 5.0 | 2.0 | 7.0 | 1.1 | 1.0 | 2.0 |
| Recording medium 5 | 100 | — | 0 | Particle A | 3.0 | 2.0 | 7.0 | 1.1 | 1.0 | 2.0 |
| Recording medium 6 | 100 | — | 0 | Particle A | 3.0 | 2.0 | 7.0 | 1.1 | 1.0 | 2.0 |
| Recording medium 7 | 100 | — | 0 | Particle E | 5.0 | 2.0 | 7.0 | 1.1 | 1.0 | 2.0 |
| Recording medium 8 | 100 | — | 0 | Particle E | 5.0 | 2.0 | 7.0 | 1.1 | 1.0 | 2.0 |
| Recording medium 9 | 100 | — | 0 | Particle A | 3.0 | 2.0 | 7.0 | 1.1 | 1.0 | 2.0 |
| Recording medium 10 | 100 | — | 0 | Particle A | 3.0 | 2.0 | 7.0 | 1.1 | 1.0 | 2.0 |
| Recording medium 11 | 100 | — | 0 | Particle A | 3.0 | 2.0 | 7.0 | 1.1 | 1.0 | 2.0 |
| Recording medium 12 | 100 | — | 0 | Particle A | 3.0 | 2.0 | 7.0 | 1.1 | 10.0 | 2.0 |
| Recording medium 13 | 100 | — | 0 | Particle A | 3.0 | 2.0 | 7.0 | 1.1 | 8.0 | 2.0 |
| Recording medium 14 | 100 | — | 0 | Particle A | 3.0 | 2.0 | 7.0 | 1.1 | 5.0 | 2.0 |
| Recording medium 15 | 100 | — | 0 | Particle A | 3.0 | 2.0 | 7.0 | 1.1 | 3.0 | 2.0 |
| Recording medium 16 | 100 | — | 0 | Particle A | 3.0 | 2.0 | 7.0 | 1.1 | 0.2 | 2.0 |
| Recording medium 17 | 100 | — | 0 | Particle A | 3.0 | 2.0 | 7.0 | 1.1 | 1.0 | 2.0 |
| Recording medium 18 | 100 | — | 0 | Particle A | 3.0 | 2.0 | 7.0 | 1.1 | 1.0 | 2.0 |
| Recording medium 19 | 100 | — | 0 | Particle B | 20.0 | 2.0 | 7.0 | 1.1 | 1.0 | 2.0 |
| Recording medium 20 | 100 | — | 0 | Particle C | 1.0 | 2.0 | 7.0 | 1.1 | 1.0 | 2.0 |
| Recording medium 21 | 100 | — | 0 | Particle D | 35.0 | 2.0 | 7.0 | 1.1 | 1.0 | 2.0 |
| Recording medium 22 | 100 | — | 0 | Particle E | 5.0 | 2.0 | 7.0 | 1.1 | 1.0 | 2.0 |
| Recording medium 23 | 90 | Inorganic particle dispersion liquid 2 | 10 | Particle A | 3.0 | 2.0 | 7.0 | 1.1 | 1.0 | 2.0 |
| Recording medium 24 | 80 | Inorganic particle dispersion liquid 2 | 20 | Particle A | 3.0 | 2.0 | 7.0 | 1.1 | 1.0 | 2.0 |
| Recording medium 25 | 70 | Inorganic particle dispersion liquid 2 | 30 | Particle A | 3.0 | 2.0 | 7.0 | 1.1 | 1.0 | 2.0 |
| Recording medium 26 | 60 | Inorganic particle dispersion liquid 2 | 40 | Particle A | 3.0 | 2.0 | 7.0 | 1.1 | 1.0 | 2.0 |
| Recording medium 27 | 90 | Inorganic particle dispersion liquid 3 | 10 | Particle A | 3.0 | 2.0 | 7.0 | 1.1 | 1.0 | 2.0 |
| Recording medium 28 | 90 | Inorganic particle dispersion liquid 4 | 10 | Particle A | 3.0 | 2.0 | 7.0 | 1.1 | 1.0 | 2.0 |
| Recording medium 29 | 80 | Inorganic particle dispersion liquid 4 | 20 | Particle A | 3.0 | 2.0 | 7.0 | 1.1 | 1.0 | 2.0 |

TABLE 2-continued

| Conditions for preparation of recording medium | | | | | | | | | | |
|---|---|---|---|---|---|---|---|---|---|---|
| | Third coating liquid | | | | | | | | | |
| | Inorganic particle | Other inorganic | | Large-size particle | | | | Cross- | | Large-size |
| Recording medium | dispersion liquid 1 | particle dispersion liquid | | | Particle size | | Binder | linking agent | Film thickness | particle/Inorganic particle |
| No. | (Part) | Type | (Part) | Type | (μm) | (Part) | (Part) | (Part) | (μm) | (mass %) |
| Recording medium 30 | 70 | Inorganic particle dispersion liquid 4 | 30 | Particle A | 3.0 | 2.0 | 7.0 | 1.1 | 1.0 | 2.0 |
| Recording medium 31 | 100 | — | 0 | Particle A | 3.0 | 0.5 | 7.0 | 1.1 | 1.0 | 0.5 |
| Recording medium 32 | 100 | — | 0 | Particle A | 3.0 | 5.0 | 7.0 | 1.1 | 1.0 | 5.0 |
| Recording medium 33 | 100 | — | 0 | Particle A | 3.0 | 0.2 | 7.0 | 1.1 | 1.0 | 0.2 |
| Recording medium 34 | 100 | — | 0 | Particle A | 3.0 | 7.0 | 7.0 | 1.1 | 1.0 | 7.0 |

[Evaluation]

In the present invention, AA to B in the evaluation criteria of "Evaluation of page-flipping property of recording medium", "Evaluation of ink-absorbing property", and "Evaluation of conveyance scratch resistance" described below were considered to be a preferred level, and C and D in the evaluation criteria were considered to be an unacceptable level. When an image was recorded on a recording medium in each of the evaluations described below, the recording was conducted using an ink-jet recording apparatus PIXUS MP990 (manufactured by CANON KABUSHIKI KAISHA) including an ink cartridge BCI-321 (manufactured by CANON KABUSHIKI KAISHA) therein. The recording was conducted at a temperature of 23° C. and at a relative humidity of 50%. In the above ink-jet recording apparatus, an image recorded under the conditions that one droplet of about 11 ng of an ink is provided in a unit region of 1/600 inch×1/600 inch at a resolution of 600 dpi×600 dpi is defined as 100% of a recording duty.

(Evaluation of Page-Flipping Property of Recording Medium)

A photo-album was prepared using 20 recording media that were cut to A4 size. The page-flipping property of the recording media was evaluated by flipping through the photo-album with a finger. The evaluation criteria are as follows. The evaluation results are shown in Table 3.

AA: Slidability of the surface was very high and the page-flipping property was very good.

A: Slidability of the surface was high and the page-flipping property was good.

B: The surface had slidability and the pages were easily flipped through.

C: Slidability of the surface was low and the recording media tended to slightly adhere to each other. The page-flipping property was somewhat poor.

D: Slidability of the surface was very low and the recording media tended to adhere to each other. The page-flipping property was poor.

(Evaluation of Ink-Absorbing Property)

Five green solid images having recording duties of 150%, 200%, 250%, 300%, and 350% were recorded on recording media using the above ink-jet recording apparatus. The ink-absorbing property was evaluated by visually observing the occurrence or non-occurrence of a beading phenomenon in the images. The beading phenomenon is a phenomenon in which ink droplets before being absorbed in a recording medium are combined with each other. It is known that the beading phenomenon is highly correlated with the ink-absorbing property. When the beading phenomenon does not occur even in an image having a high recording duty, it is determined that the ink-absorbing property is high. The evaluation results are shown in Table 3.

AA: The beading phenomenon did not occur even in the image having a recording duty of 350%.

A: The beading phenomenon did not occur in the image having a recording duty of 300% but occurred in the image having a recording duty of 350%.

B: The beading phenomenon did not occur in the image having a recording duty of 250% but occurred in the image having a recording duty of 300%.

C: The beading phenomenon did not occur in the image having a recording duty of 200% but occurred in the image having a recording duty of 250%.

D: The beading phenomenon occurred even in the image having a recording duty of 200%.

(Evaluation of Conveyance Scratch Resistance)

The above ink-jet recording apparatus was modified so that the pressure of a conveying roller could be adjusted to 1.5 to 2.0 kgf. A black solid image (having a recording duty of 100%) was recorded over the entire surface of a recording medium using the ink-jet recording apparatus. The conveyance scratch resistance of the recording medium was evaluated by visually observing the presence or absence of a conveyance scratch formed by the conveying roller and on the recording medium after recording. The evaluation criteria are as follows. The evaluation results are shown in Table 3.

AA: No conveyance scratch was observed even when the pressure of the conveying roller was 2.0 kgf.

A: No conveyance scratch was observed when the pressure of the conveying roller was 1.8 kgf. However, a conveyance scratch was observed when the pressure of the conveying roller was 2.0 kgf.

B: No conveyance scratch was observed when the pressure of the conveying roller was 1.7 kgf. However, a conveyance scratch was observed when the pressure of the conveying roller was 1.8 kgf.

C: No conveyance scratch was observed when the pressure of the conveying roller was 1.5 kgf. However, a conveyance scratch was observed when the pressure of the conveying roller was 1.7 kgf.

D: A conveyance scratch was observed even when the pressure of the conveying roller was 1.5 kgf.

(Evaluation of Glossiness)

The 20° glossiness of a recording medium was evaluated with a gloss meter VG-2000 (manufactured by Nippon Denshoku industries Co., Ltd.). The evaluation results are shown in Table 3.

AA: The 20° glossiness was 25 or more.
A: The 20° glossiness was 20 or more and less than 25.
B: The 20° glossiness was 15 or more and less than 20.
C: The 20° glossiness was 10 or more and less than 15.
D: The 20° glossiness was less than 10.

TABLE 3

| | | Evaluation results | | | |
|---|---|---|---|---|---|
| | | Evaluation results | | | |
| Example No. | Recording medium No. | Page-flipping property of recording medium | Ink-absorbing property | Conveyance scratch resistance | Glossiness |
| Example 1 | Recording medium 1 | AA | AA | A | AA |
| Example 2 | Recording medium 2 | AA | A | A | AA |
| Example 3 | Recording medium 3 | B | B | A | AA |
| Example 4 | Recording medium 4 | B | B | A | AA |
| Example 5 | Recording medium 5 | AA | AA | A | AA |
| Example 6 | Recording medium 6 | AA | AA | AA | AA |
| Example 7 | Recording medium 7 | B | A | AA | AA |
| Example 8 | Recording medium 8 | B | B | B | AA |
| Example 9 | Recording medium 9 | AA | A | AA | AA |
| Example 10 | Recording medium 11 | AA | AA | B | AA |
| Example 11 | Recording medium 12 | AA | B | AA | B |
| Example 12 | Recording medium 13 | AA | AA | A | B |
| Example 13 | Recording medium 14 | AA | B | A | A |
| Example 14 | Recording medium 15 | AA | AA | A | A |
| Example 15 | Recording medium 16 | AA | AA | A | AA |
| Example 16 | Recording medium 19 | AA | A | AA | B |
| Example 17 | Recording medium 20 | A | A | B | AA |
| Example 18 | Recording medium 22 | B | B | A | AA |
| Example 19 | Recording medium 23 | AA | AA | AA | AA |
| Example 20 | Recording medium 24 | AA | AA | AA | AA |
| Example 21 | Recording medium 25 | AA | AA | AA | A |
| Example 22 | Recording medium 26 | AA | AA | AA | A |
| Example 23 | Recording medium 27 | AA | AA | AA | A |
| Example 24 | Recording medium 28 | AA | AA | AA | AA |
| Example 25 | Recording medium 29 | AA | AA | AA | AA |
| Example 26 | Recording medium 30 | AA | AA | AA | AA |
| Example 27 | Recording medium 31 | AA | AA | A | AA |
| Example 28 | Recording medium 32 | AA | AA | AA | B |
| Example 29 | Recording medium 34 | AA | B | AA | C |
| Comparative Example 1 | Recording medium 10 | AA | C | A | AA |
| Comparative Example 2 | Recording medium 17 | AA | D | A | AA |
| Comparative Example 3 | Recording medium 18 | AA | C | A | AA |
| Comparative Example 4 | Recording medium 21 | AA | C | AA | D |
| Comparative Example 5 | Recording medium 33 | A | C | C | AA |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-176023 filed Aug. 8, 2012, which is hereby incorporated by reference herein in its entirety.

What is claimed is:

1. A recording medium comprising, in sequence:

a support;

a first ink-receiving layer;

a second ink-receiving layer; and a third ink-receiving layer which is an outermost surface layer of the recording medium, wherein the first ink-receiving layer comprises a first inorganic particle and a first binder, wherein the second ink-receiving layer comprises a second inorganic particle and a second binder, wherein a mass ratio of a content of the first binder to a content of the first inorganic particle in the first ink-receiving layer is larger than a mass ratio of a content of the second binder to a content of the second inorganic particle in the second ink-receiving layer, wherein the third ink-receiving layer comprises a third inorganic particle, a third binder, and a particle which is different from the third inorganic particle and has an average secondary particle size of 1.0 μm or more and 20.0 μm or less, and wherein a content of the particle having an average secondary particle size of 1.0 μm or more and 20.0 μm or less is 0.5% by mass or more with respect to a content of the third inorganic particle in the third ink-receiving layer.

2. The recording medium according to claim 1, wherein the mass ratio of the content of the first binder to the content of the first inorganic particle in the first ink-receiving layer is 10.5% by mass or more and 17.0% by mass or less.

3. The recording medium according to claim 1, wherein the mass ratio of the content of the second binder to the content of the second inorganic particle in the second ink-receiving layer is 7.0% by mass or more and 10.5% by mass or less.

4. The recording medium according to claim 1, wherein the first ink-receiving layer further comprises a first cross-linking agent, and wherein a mass ratio of a content of the first cross-linking agent to a content of the first binder in the first ink-receiving layer is 10.5% by mass or more and 20.0% by mass or less.

5. The recording medium according to claim 1, wherein the second ink-receiving layer further comprises a second cross-linking agent, and wherein a mass ratio of a content of the second cross-linking agent to a content of the second binder in the second ink-receiving layer is 8.8% by mass or more and 23.8% by mass or less.

6. The recording medium according to claim 1, wherein the content of the particle having an average secondary particle size of 1.0 μm or more and 20.0 μm or less is 5.0% by mass or less with respect to the content of the third inorganic particle in the third ink-receiving layer.

7. The recording medium according to claim 1, wherein the particle having an average secondary particle size of 1.0 μm or more and 20.0 μm or less has an average secondary particle size larger than the average secondary particle size of the third inorganic particle in the third ink-receiving layer.

8. The recording medium according to claim 1, wherein the third inorganic particle in the third ink-receiving layer has an average secondary particle size of 0.1 nm or more and 500 nm or less.

9. The recording medium according to claim 1, wherein the third inorganic particle in the third ink-receiving layer is at least one selected from alumina, hydrated alumina, vapor-phase-process silica, and wet-process silica, and wherein the particle having an average secondary particle size of 1.0 μm or more and 20.0 μm or less is at least one selected from wet-process silica and a resin particle.

10. The recording medium according to claim 9, wherein the particle having an average secondary particle size of 1.0 μm or more and 20.0 μm or less in the third ink-receiving layer is wet-process silica.

11. The recording medium according to claim 1, wherein the first ink-receiving layer further comprises a first cross-linking agent, the second ink-receiving layer further comprises a second cross-linking agent, and the third ink-receiving layer further comprises a third cross-linking agent, and wherein the first cross-linking agent, the second cross-linking agent, and the third cross-linking agent are each independently at least one selected from a boric acid and a borate.

* * * * *